United States Patent [19]

Anzola et al.

[11] Patent Number: 4,659,447

[45] Date of Patent: Apr. 21, 1987

[54] APPARATUS AND INSTALLATION FOR PRODUCING AN ELECTROLYTIC METALLIC DEPOSIT OF CONSTANT THICKNESS

[75] Inventors: Michel Anzola, Bretigny/Orge; Daniel Lefevre, Longvilliers; Patrick Massicot, Vanves, all of France

[73] Assignee: Commissariat a l'Energie Atomique, Paris, France

[21] Appl. No.: 836,478

[22] Filed: Mar. 5, 1986

[30] Foreign Application Priority Data

Mar. 12, 1985 [FR] France ..... 85 03590

[51] Int. Cl.[4] ..... C25D 17/06

[52] U.S. Cl. ..... 204/212

[58] Field of Search ..... 204/212, 272, DIG. 7

[56] References Cited

U.S. PATENT DOCUMENTS

| | | | |
|---|---|---|---|
| 3,941,674 | 3/1976 | Vanmunster | 204/212 |
| 4,497,693 | 2/1985 | Ogura | 204/212 |
| 4,584,081 | 4/1986 | Coulon | 204/212 |

*Primary Examiner*—T. M. Tufariello

*Attorney, Agent, or Firm*—Kerkam, Stowell, Kondracki & Clarke

[57] ABSTRACT

Apparatus for producing a metallic deposit of constant thickness of elongated metal revolution parts. It comprises a plate mounted in rotary manner and having a plurality of height-regulatable rods distributed round a circle, each rod having a bore able to receive a threaded end of a part to be treated, a cover mounted around each rod and sliding thereon between a top position and a bottom position, as well as means for connecting each rod to the negative terminal of a direct current source.

12 Claims, 6 Drawing Figures

APPARATUS AND INSTALLATION FOR PRODUCING AN ELECTROLYTIC METALLIC DEPOSIT OF CONSTANT THICKNESS

BACKGROUND OF THE INVENTION

Electrolytic coatings are made on at least the surface of conductive parts, which are placed in baths with a precise composition and connected to the negative pole of a direct current source. The positive pole of the source is connected to conductive parts, called anodes, which are immersed in the bath.

In order that the deposition operation is correctly carried out and leads to a good quality coating, i.e. of constant thickness and with a good appearance, it is indispensable to prepare the surface of the part. This surface preparation involves the pickling of the part and the elimination of any foreign coating normally on the surface of the base metal, i.e. grease, oxide, calamine, etc.

In the case of the standard metals, such as iron, copper or alloys thereof, the existing processes give satisfactory results. However, these processes are not usable when the material to be coated is an easily oxidizable or corrodable metal, because coatings of oxides or products resulting from the pickling operation remain on the surface after the final washing. This is particularly the case with alloyed or unalloyed uranium.

In the case of metals of this type, it is necessary to use a process for the surface preparation of the parts, like that described in FR-A-No. 1 564 575. However, to obtain an electrolytic metallic deposit of constant thickness, other conditions have to be combined.

It is necessary for the parts to be coated to be transferred rapidly from one bath to another in order to prevent their oxidation on contact with air during the transfer time. It is also necessary for the orientation of the parts with respect to the current lines in the electrolytic bath do not lead to the deposition of an excess thickness at certain points on the part. For this purpose, it is necessary for the orientation of the part not to favour any portion of its periphery which can be obtained by rotating the part on itself, but this would involve a complex operation.

Finally, it is necessary to avoid excess thicknesses, which might occur on the part level with the electrolytic bath surface. Moreover, it is desirable for several parts to be treated simultaneously, in order to reduce the treatment time for each part.

SUMMARY OF THE INVENTION

The present invention relates to apparatus for producing a metallic deposit of constant thickness on elongated metal parts of revolution making it possible to achieve these objectives. This apparatus comprises a plate mounted in rotary manner and having a plurality of height-regulatable rods distributed over a circle, each rod having a bore able to receive a threaded end of a part to be treated, a cover mounted around each rod and sliding thereon between a high position and a low position, as well as means for connecting each rod to the negative terminal of a direct current source.

Preferably, the means for connecting each rod to the positive terminal of a direct current source are constituted by electric wires connecting each nut to the negative terminal, the external surfaces of the rod and wires being electrically insulated.

Preferably, the equipment has means for simultaneously controlling the displacement of each of the covers, said means being constituted by a support plate engaging said covers and by a control rod fixed to the said support plate.

The invention also relates to an installation for producing a metallic deposit of constant thickness on elongated metal parts of revolution, said installation comprising an anodic pickling bath with buffer, a rinsing bath, an electrochemical anodic etching bath using metal salts, a rinsing bath, a tank containing a quantity of an electrolyte, an essentially circular anode immersed in said electrolyte and connected to the positive terminal of a direct current source, as well as means for bringing an apparatus successively above each bath and above the electrolyte tank, together with means for raising and lowering said apparatus with respect to each of these tanks and the electrolyte tank.

Preferably, the anode is constituted by a ring and a planar plate located in the centre of the ring and electrically connected thereto, the height of the ring being proportional to the length of the part to be treated.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
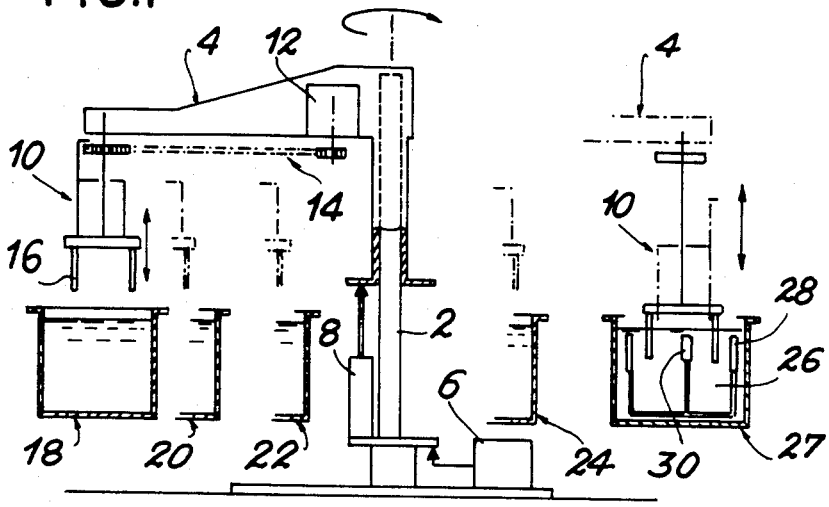
FIG. 1—A sectional view of an apparatus for producing an electrolytic metallic deposit according to the invention.

The installation shown in FIG. 1 comprises a column 2 supporting an arm 4 mounted in overhung manner on the end of column 2. Column 2 rotates about its vertical axis and is controlled in rotation by a diagrammatically represented device 6, e.g. a motor driving a toothed wheel, which drives a ring integral with column 2. Arm 4 can be raised and lowered by a raising and lowering device, such as a jack 8. In FIG. 1, the arm is shown in the raised position.

Arm 4 supports an apparatus, which is diagrammatically represented and designated by the general reference numeral 10 and which will be described in greater detail hereinafter. This apparatus rotates with respect to arm 4, being rotated by a motor 12 connected to apparatus 10 by a transmission device, such as a chain or a belt 14. Apparatus 10 supports a plurality of parts 16 to be coated with an electrolytic metallic deposit. These parts are elongated and have a revolution shape.

As a result of the raising and lowering device 8, said parts 16 can be immersed in successive baths 18, 20, 22, 24 and 26. A rotation of arm 4 makes it possible to pass from one bath to the next when said arm is raised. Bath 18 is an anodic pickling bath with a buffer and is constituted by 2N sulphuric acid $H_2SO_4$. The open circuit anode voltage is 4 V when the parts 16 are not immersed.

Bath 18 is followed by a rinsing bath 20 and then an anodic electrochemical etching bath 22 using metal salts. In a manner known e.g. from FR-A-No. 1 564 575, the latter bath is constituted by $Li_2SO_4H_2O$ at a concentration of 255 g per liter and $H_2SO_4$ at a concentration of 65 ml per liter. The pH is between 0.5 and 1. The bath temperature is the same as ambient temperature. The anode current density I is equal to $4A/dm^2$.

This electrochemical etching bath is followed by a rinsing bath 22 and then a nickel plating bath 24. This bath contains 140 g per liter of $7H_2O$ nickel sulphate and 160 g per liter of $10H_2O$ sodium sulphate, 19 g/l of KCl, 37 g/l of $H_3BO_4$ and 0.5 g/l of Duponol. The pH is adjusted to 4.25 by $H_2SO_4$. The temperature is 45° C. and the current density I is $3A/dm^2$.

Figure 2:
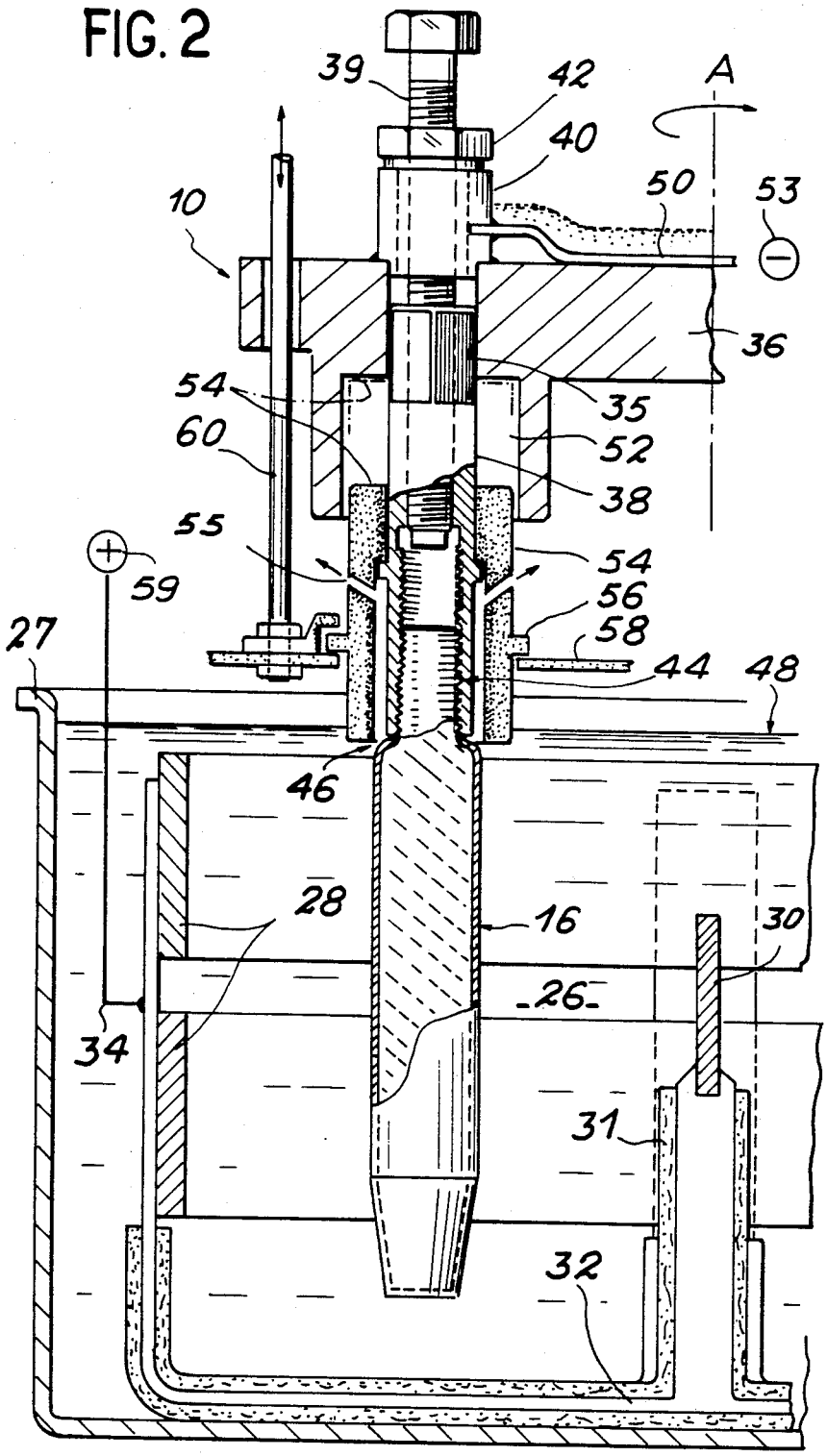
FIG. 2—A larger scale view of a tank for electrolytic deposition forming part of the installation of FIG. 1.

FIG. 2 is a detail showing in section the tank 27 containing the nickel plating bath 26, whose composition was given hereinbefore. An anode in two parts 28, 30 is immersed in the bath. The first anode part 28 is shaped like a ring with a rectangular section, whilst the second anode part 30 is a vertical plate located in the centre of ring 28. Anode parts 28, 30 are electrically interconnected by feet integral with a cross 32 having four horizontal branches at 90° of one another. The four feet of anode 28 are connected to the tops of the branches of cross 32, whilst the foot 31 of anode 30 is fixed to the centre of said cross. The feet 31 are electrically insulated from bath 26. Anode parts 28, 30 are electrically connected to the positive terminal 59 of a direct current source by wire 34.

The height of anodes 28, 30 is a function of the length of the parts to be treated. It is for this reason that in a single operation it is only possible to treat parts of the same length. Anode parts 28, 30 have a height which is slightly less than the length of the part to be treated. Two superimposed rings 28 fulfil the same function as an anode having a height equal to the sum of the heights of each of these anodes.

The apparatus 10 making it possible to immerse and remove parts 16 with respect to the different baths (only one part is shown in FIG. 2) has a plate 36, which is mounted so as to rotate about axis A. It has eight holes 35 with a square section and distributed at 45° intervals over a circle concentric to axis A.

Support rods 38 having an upper end with a square cross-section are engaged in holes 35. This arrangement makes it possible to immobilize them in secondary rotation. The rods 38 are internally threaded at their two ends. These threads can have the same or different diameters.

A screw 39 is engaged in the upper end of the thread of rod 38. This screw passes through a nut 40 fixed to the upper face of plate 36, concentrically with respect to the holes 35. By tightening or loosening screw 39, it is possible to vary the height of rod 38, which makes it possible to regulate the height of the latter.

A lock nut 42 makes it possible to immobilize in rotation screw 39. A thread provided on the inner portion of rod 38 serves to receive a threaded end 44 formed on part 16. In the represented embodiment and as will be described in greater detail hereinafter, part 16 is a plug intended for an irradiation device and said plug is also called a "glove finger". As plate 36 is in the lowered position it is possible to regulate the height of rod 38 in such a way that the shoulder 46 of the part is flush with the bath surface 48. Lock nut 42 is then locked in order to immobilize the screw 49 in this position. It is also pointed out that nut 40 is electrically connected by means of a wire 50 to the negative terminal 53 of the aforementioned direct current source. Wires 50 are covered with an insulating layer. A clearance 52 is provided around each rod 38 on the lower face of plate 36. A cover 54 having vent holes 55 is slidingly mounted around screw 38. Cover 54 can be displaced between a bottom position, in which it is shown in FIG. 2, and a top position, which it occupies when its upper portion penetrates the clearance 52 concentric to rod 38. In the described embodiment, cover 54 is mounted with slightly hard friction on the external diameter of rod 38, so that it remains in the top or bottom position in which it is placed without any other fixing means.

FIG. 2 shows the special means making it possible to simultaneously raise or lower all, e.g. the eight covers of each of the parts to be coated. Each cover 54 has an outwardly projecting collar 56, which engages a raising and lowering plate for the covers 54. The movement of the support plate 58 is controlled by a control rod 60 fixed to each plate.

The function of each of the covers 54 is to prevent the formation of an excessive deposition thickness at shoulder 46 on part 16. The covers are in the raised position during the stage corresponding to the surface preparation, i.e. when the parts to be treated are immersed in baths 18, 20, 22 and 24. During the nickel plating operations, the covers are placed in the bottom position, as shown in FIG. 2. Covers 54, as well as plate 36 are preferably made of a plastic material such as Lucoflex.

In the represented embodiment, a nickel deposit is made on a uranium or uranium alloy part. However, it would also be possible to produce a gold, silver or chromium deposit.

In most cases, the deposit thickness is between 50 and 100 microns. In the represented embodiment, a thickness of 60 microns is deposited with an accuracy of ±5 microns. Thus, this thickness is perfectly uniform, which is particularly the case when the bath temperature is low, i.e. approximately 60° C. and consequently does not deform the parts to be coated.

Figure 3:
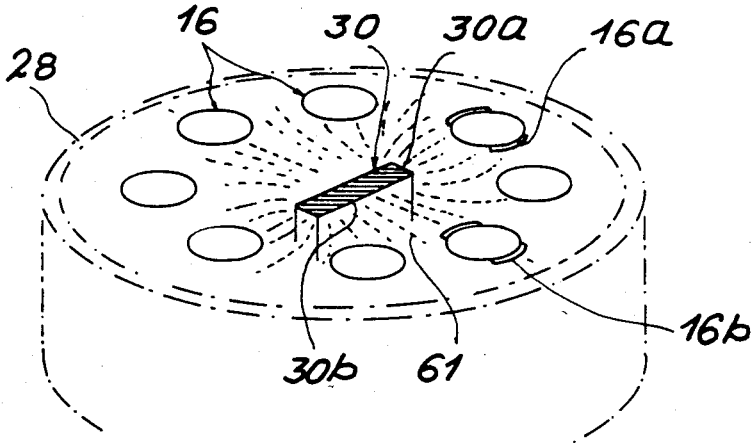
FIG. 3—A perspective view illustrating the path of the current lines in the electrolytic deposition tank of FIG. 2.

FIG. 3 is a diagrammatic perspective view illustrating the distribution of the current lines between anodes 28 and 30 immersed in electrolytic bath 26 and the eight parts 16 distributed over angles of 45°. Anode 30 has a rectangular cross-section. The small sides **30*a* of the rectangle have a much smaller size than the large sides 30*b* of the rectangle. There is a concentration of current lines 61, diagrammatically illustrated by the broken lines, between electrode 30 and portions 16*a* of parts 16, in the vicinity of these small sides 30*a*. However, the current lines 59 are more widely spaced facing the large size 30*b* of the rectangle and portions 16*b*. It is for this reason that plate 36 performs a uniform rotary movement so that each of the parts 16 is alternately positioned for equal time intervals facing the small sides 30*a* and the large sides 30*b* of the rectangle, so as to obtain a uniform distribution of the deposit in accordance with the circumference of these parts. This result is obtained in a simple manner without it being necessary to rotate each of the parts about its revolution axis. An overall rotation of plate 36** is sufficient to ensure a uniform distribution of the nickel deposit on all eight parts. Moreover, the solution consisting of rotating each of the parts to be coated by means of a separate motor would involve a current supply problem, because a moving contact would be required. Only a single moving contact is required as a result of the invention.

Figure 4:
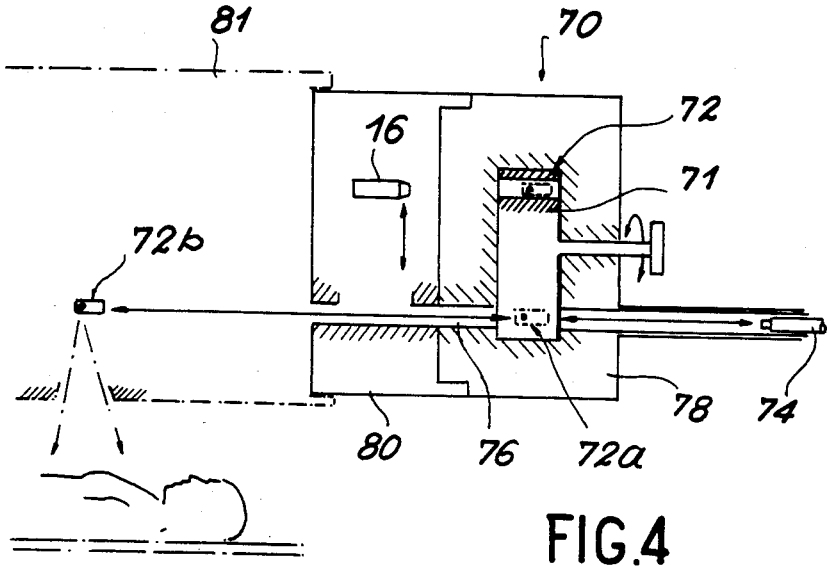
FIG. 4—A diagrammatic view of an irradiation device having a plug coated with an electrolytic deposit in an installation according to the invention.
Figure 5:
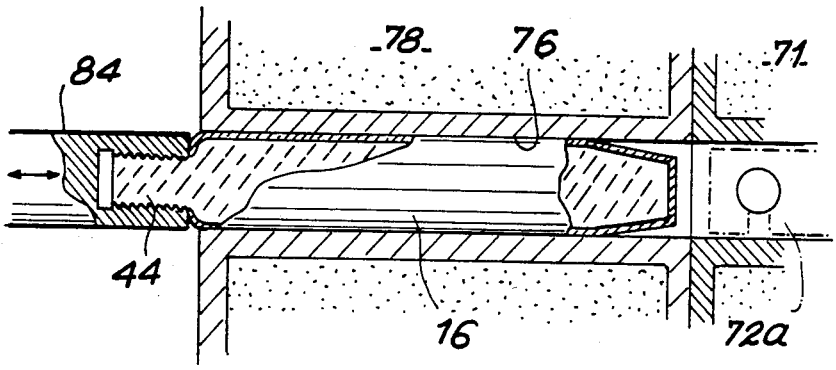
FIG. 5—A larger scale view of the plug of the irradiation device shown in FIG. 4.

FIG. 4 is a highly diagrammatic view of an irradiation device 66, e.g. using an X-ray source 72. Source 72 is mounted in a cavity of a rotary drum 71 making it possible to pass the source from a first position shown in FIG. 4 in which the source is in the storage position to a second position 72*a* from which it can be brought into a working position 72*b*, e.g. by using a transfer rod 74. So as to prevent any danger of accidental irradiation, a plug 16 can be introduced by known means 80 into the opening 76 of shielding 78. Plug 16 is made from depleted uranium, because this metal has a very high mass and consequently a high radiation absorption power. However, as depleted uranium is fragile, it must be externally coated with a protective metal layer which resists friction, e.g. nickel. The resulting installation according to the invention and which has been described with reference to FIGS. 1 to 3 makes it possible to produce a perfectly homogeneous nickel deposit on plug 16. As can be seen from FIG. 5, the threaded end 44 of plug 16 permits its manipulation by means of a transfer rod 84 forming part of means 80.

Figure 6:
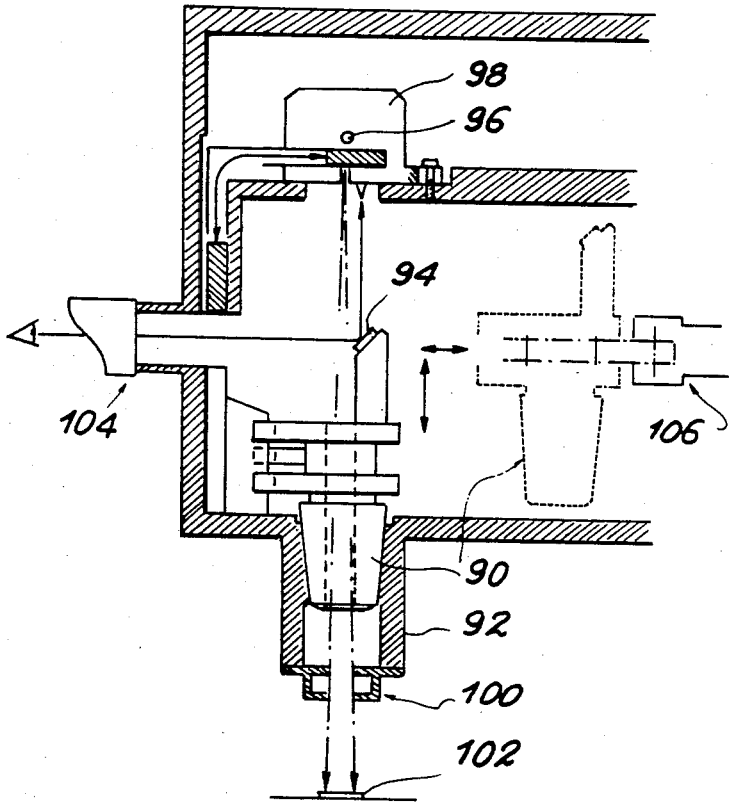
FIG. 6—A diagrammatic view illustrating a second exemplified application of an elongated part of revolution coated with an electrolytic metallic deposit in an installation according to the invention.

FIG. 6 shows a second application of a revolution part 90, which is to be coated with a protective metal. Part 90 is a conical positioner, which can be very accurately positioned with respect to a frame 92. Positioner 90 supports a mirror 94 inclined by 45°. A radioactive source 96 is mounted on a support 98, whereof the position relative to frame 92 must be regulated. The assembly also has a collinator 100 and a target 102 behind said collinator. It is possible to regulate the position of source 96 in such a way that it is precisely located in the axis of collinator 100. To this end, the position regulation takes place by using mirror 94 and observing the position of the source through a reticule 104. When the correct position is obtained, the positioner is sought by means of a fork 106, shown in mixed line form and which makes it possible to retract it, so that source 96 comes into action.

What is claimed is:

1. An apparatus for producing a metallic deposit of constant thickness on elongated metal parts of revolution, wherein said apparatus comprises a plate mounted in rotary manner and having a plurality of height-regulatable rods distributed over a circle, each rod having a bore able to receive a threaded end of a part to be treated, a cover mounted around each rod and sliding thereon between a top position and a bottom position and means for connecting each rod to the negative terminal of a direct current source.

2. An apparatus according to claim 1, wherein the means for connecting each rod to the positive terminal of a direct current source are constituted by electric wires connecting each nut to said negative terminal, the outer surfaces of the rod and the wires being electrically insulated.

3. An apparatus according to claim 1, wherein said apparatus has means for simultaneously controlling the displacement of each of the covers, said means being constituted by a support plate engaging said covers and by a control rod fixed to said support plate.

4. An apparatus according to claim 1, wherein the covers and plate are made from a plastic material.

5. An installation for producing a metallic deposit of constant thickness on elongated metal revolution parts, wherein it comprises an anodic pickling bath with buffer, a rinsing bath, an anodic electrochemical etching bath using metal salts, a rinsing bath, a tank containing a quantity of an electrolyte, an essentially circular anode immersed in said electrolyte and connected to the positive terminal of a direct current source, said apparatus disposed successively above each bath and above the elecrolyte tank, together with means of raising and lowering said apparatus with respect to each of these tanks and the electrolyte tank, said apparatus including a plate mounted in rotary manner and having a plurality of height-regulatable rods distributed over a circle, each rod having a bore able to receive a threaded end of a part to be treated, a cover mounted around each rod and sliding thereon between a top position and a bottom position and means for connecting each rod to the negative terminal of a direct current source.

6. An installation according to claim 5 wherein the anode is constituted by a ring and a flat plate located in the centre of the ring and electrically connected thereto, the height of the ring being proportional to the length of the part to be treated.

7. An apparatus according to claim 5, wherein the means for connecting each rod to the positive terminal of a direct current source are constituted by electric wires connecting each nut to said negative terminal, the outer surfaces of the rod and the wires being electrically insulated.

8. An installation according to claim 7, wherein the anode is constituted by a ring and a flat plate located in the centre of the ring and electrically connected thereto, the height of the ring being proportional to the length of the part to be treated.

9. An apparatus according to claim 5 wherein said apparatus has means for simultaneously controlling the displacement of each of the covers, said means being constituted by a support plate engaging said covers and by a control rod fixed to said support plate.

10. An installation according to claim 9 wherein the anode is constituted by a ring and a flat plate located in the centre of the ring and electrically connected thereto, the height of the ring being proportional to the length of the part to be treated.

11. An apparatus according to claim 5, wherein the covers and plate are made from a plastic material.

12. An installation according to claim 11 wherein the anode is constituted by a ring and a flat plate located in the centre of the ring and electrically connected thereto, the height of the ring being proportional to the length of the part to be treated.

* * * * *